US005161697A

United States Patent [19]

Quick

[11] Patent Number: 5,161,697

[45] Date of Patent: * Nov. 10, 1992

[54] APPARATUS FOR SELECTING WOOD STOCK TO FORM PANELS OF PREDETERMINED SIZE

[75] Inventor: Bradley S. Quick, Staatsburg, N.Y.

[73] Assignee: James L. Taylor Manufacturing Company, Poughkeepsie, N.Y.

[ * ] Notice: The portion of the term of this patent subsequent to Jul. 24, 2007 has been disclaimed.

[21] Appl. No.: 412,168

[22] Filed: Sep. 25, 1989

Related U.S. Application Data

[63] Continuation-in-part of Ser. No. 157,409, Feb. 18, 1988, Pat. No. 4,943,328.

[51] Int. Cl.[5] ..... B07C 5/14; B07C 5/00

[52] U.S. Cl. ..... 209/552; 209/590; 209/518; 209/936; 156/351; 156/360; 156/363; 198/502.2; 198/451

[58] Field of Search ..... 209/517, 518, 519-521, 209/658, 659, 661, 576, 675, 679, 546, 549, 551, 552, 590, 936; 198/349, 352, 362, 363, 502.2, 447, 448, 451; 156/546, 557, 351, 558-563, 64, 378, 379, 350, 362, 363, 360, 277

[56] References Cited

U.S. PATENT DOCUMENTS

| | | | |
|---|---|---|---|
| 1,428,765 | 9/1922 | Elmendorf . | |
| 2,526,342 | 10/1950 | Frisch . | |
| 2,762,500 | 9/1956 | Darton | 209/520 |
| 3,835,979 | 9/1974 | Calveut et al. | 198/363 |
| 4,195,346 | 3/1980 | Schröder . | |
| 4,195,737 | 4/1980 | Rysti | 209/521 |
| 4,225,790 | 9/1980 | Yoshida | 209/590 |
| 4,266,674 | 5/1981 | Bell et al. | 209/546 X |
| 4,413,518 | 11/1983 | Jones | 367/98 X |
| 4,457,622 | 7/1984 | Kato et al. | 209/586 |
| 4,512,840 | 4/1985 | Marino . | |
| 4,576,286 | 3/1986 | Buckley | 209/590 X |
| 4,869,813 | 9/1989 | Bailey et al. | 209/556 |
| 4,943,328 | 7/1990 | Quick | 156/64 |

*Primary Examiner*—David A. Simmons
*Assistant Examiner*—Chester T. Barry

[57] ABSTRACT

The present invention represents a further extension of the automation of the various steps of the wood gluing process. This invention automatically selects and transmits to further work stations appropriately sized pieces of stock which, when glued together (utilizing various of the apparatus shown in the art for gluing such strips together), saves time in the formation of the end products. Information concerning the operation of the invention is recorded by customer number or other code to provide a permanent record of the results of the invention's operation.

11 Claims, 7 Drawing Sheets

APPARATUS FOR SELECTING WOOD STOCK TO FORM PANELS OF PREDETERMINED SIZE

CROSS-REFERENCE TO RELATED APPLICATION

This application is a continuation in part of my co-pending application Ser. No.: 07/157,409, now U.S. Pat. No. 4,943,328 filed Feb. 18, 1988, commonly assigned.

BACKGROUND OF THE INVENTION

1. Field of the Invention

This invention relates to the formation of panels of wood by gluing together smaller sized pieces of wood so as to utilize scrap wood materials which would otherwise be discarded and form usable panels therefrom.

2. Description of Related Art

Elmendorf, U.S. Pat. No. 1,428,765, forms sheets of wood from edge-glued wood strips using spacing grids formed by bars. Rails allow the strips to slide on the grids. The grids are used to carry edge-glued strips which are manually placed on each grid. A number of such supporting grids are shaped by stretching and compressing.

Frisch, U.S. Pat. No. 2,526,342, shows edge-bonding apparatus where glue is applied to the edges of the boards on an infeed table. The glued boards are fed into an area where a plurality of horizontal plungers apply pressure across the end of the edge-bonded boards. Upper and lower platens are provided which move into and out of engagement on the boards as same move into the pressurized area of the apparatus. The upper and lower platens apply RF energy to the wood to cure the glue in the gluing operation. FIG. 10 of this patent shows a plurality of plungers utilized in the apparatus. The plungers serve to apply pressure uniformly to the sides of the board already selected for gluing. The plungers do not serve to advance selected boards beyond a predetermined point for further processing.

Schroeder, U.S. Pat. No. 4,195,346, shows an apparatus to sort and classify lumber utilizing a computer programmed to select certain pieces. Schroeder's system selects based on the length and quality of the lumber and develops electrical control signals from these inputs. The control signals indicative of length and quality are fed into a computer programmed to select optimal cut-off length and optimum quality and to feed these selections to cutting or sorting apparatus so that the appropriate operations can be performed on selected pieces of lumber.

The Schroeder system is designed to work in a saw-mill. Schroeder requires and relies on a visual inspection made by a human inspector who manually depresses buttons he selects based on the inspector's judgment made by viewing the boards. The boards so classified by the inspector are transferred on a sorting conveyor. Kickers are provided to knock off the boards so that they are placed in selected bins. Schroeder requires that an operator manually depress buttons indicative of criteria of wood boards which he observes from his inspection station. The computer then, based on preset criteria, compares the results of the signals generated by the depressed buttons with preset information and causes the boards to be conveyed automatically to preselected locations for further processing in the saw-mill.

Marino, U.S. Pat. No. 4,512,840, shows a machine for forming planks by gluing a number of wood fillets together. The planks are obtained from uniform sized wood fillets. Each plank is thirteen fillets wide and several meters long. Marino shows a feed station for the thirteen fillets. As the fillets are all of uniform size, Marino does not require any sizing, selection or processing based on the results of size analysis.

SUMMARY AND OBJECTS OF THE INVENTION

The present invention relates to a method and apparatus for selecting wood stock of various sizes automatically and to convey the stock to a series of locations which carry them to work areas where gluing rollers and other operations are performed to process the selected pieces of stock. Specifically, the invention employs a track section with thirteen distinct tracks having conveying means in which thirteen pieces of wood stock are positioned. The pieces of stock are of uniform length and thickness but are of unequal widths. The boards are placed in each of the tracks with their non-uniform dimension upright in the track.

The conveying means brings all of the separate wood boards up to a scanning area. The scanning area utilizes a track mounted analog proximity sensor positioned perpendicularly to the conveyor for the boards so that the proximity sensor will scan the height of each of the thirteen boards each time the scanner passes along the length of its track. The data received from the scanning sensors as to the height of the various thirteen boards is fed to a computer which computes which combination of the thirteen boards equals a predetermined size for the desired panel.

The computer then actuates a controller which, in turn, actuates selected ones of thirteen separate solenoid valves to control air to thirteen cylinders to raise or lower thirteen gates at the ends of each of the thirteen wood stock tracks. Conveyor means then conveys the selected boards to a secondary conveyor which carries them to a subsequent work area where gluing rollers and various other operations coact to further process the selected boards.

The wood gluing art is long recognized the need to automate what, for many years, has been essentially a manual operation. The field requires the cutting and sizing of strips of wood which are then glued along their edges, clamped together, the glue allowed to set, and the wooden panel, thus formed, removed for further processing. Examples of various machinery developed to automate the steps of this operation are shown in U.S. Pat. Nos. 4,374,165, 4,062,320, 4,489,925 and 3,771,779 and in U.S. patent application Ser. No. 846,363, filed Mar. 31, 1987, now U.S. Pat. No. 4,778,555 entitled Automatic Clamp Adjuster, all commonly assigned.

The present invention represents a further extension of the automation of the various steps of the wood gluing process. This invention automatically selects and transmits to further work stations appropriately sized pieces of stock which, when glued together (utilizing various of the apparatus shown in the art for gluing such strips together), saves time in the formation of the end products.

The system described in my aforementioned co-pending application, Ser. No. 157,409, now U.S. Pat. No. 4,943,328, has proven itself in operation; however, it has been found that its utility would be enhanced if the additional functions (described in this application) were added. These functions permit the system to provide additional information to and control for the operator; namely, (i) a count of the number of panels made by the apparatus and generation of control signal (which can be used to stop the apparatus) when a preset number of panels are made; and, (ii) generation of a report (on a screen or on a printer) covering the production on the machine during a time period which generates information by panel size, panel area, board feet, specie, and operator identification.

These features are incorporated in the system by modification of the computer program and the addition of a printer to give a permanent record of the display.

A principal object of the invention is the provision of apparatus which will automatically select the widths of the boards necessary to make up a panel of predetermined dimensions.

A further object of the present invention is to automate and make more efficient the fabrication of wood panels by gluing together pieces of wood.

Another object of the present invention is the provision of an apparatus which automatically stores a number of strips of wood having uniform length and thickness but non-uniform widths. The apparatus automatically selects the number of pieces of the widths presented to make up the desired panel width.

A further object of the present invention is the provision of an apparatus which automatically takes the selected pieces of wood and transmits them to a work station, first passing them over an edge-gluing roller.

Yet another object of the present invention is the provision of an automatic stop which acts to inhibit operation of the system until glued selected wood pieces are removed from the apparatus for further processing.

A still further object of the present invention is the provision of a computer program which processes the information preset by the operator for width of the panel to be formed, the number of pieces of wood to be selected and the tolerances for the panel to be formed.

A further object of the present invention is the implementation of an algorithm in the computer program, which algorithm develops output signals to select boards of different widths to make up a panel having preselected width, number of boards to be contained in the panel, and desired tolerance.

Another object of the present invention is the provision of a scanner apparatus for scanning the widths of the plurality of boards and developing output signals indicative of the width of the board and the location of each board scanned.

Yet another object of the present invention is the provision of scanning apparatus which employs an analog sensor for generating an electrical signal indicative of the width of the board which analog sensor operates by impinging compressional wave energy (ultrasonic signal) on the board and receiving a reflected signal therefrom.

A further object of the present invention is the employment in a scanning system of a digital location sensor which senses the position of the analog sensor by developing a signal based on selection of mechanical indicia for each channel where boards are mounted.

Another object of the present invention is the employment of a scanning system employing analog and digital sensors mounted on a rodless cylinder which serves to index the sensors across the width of the ends of the boards.

These as well as further objects and advantages of the invention will become apparent to those skilled in the art from a review of the following detailed specification and accompanying drawings.

DETAILED DESCRIPTION OF THE PREFERRED EMBODIMENT

Figure 1:
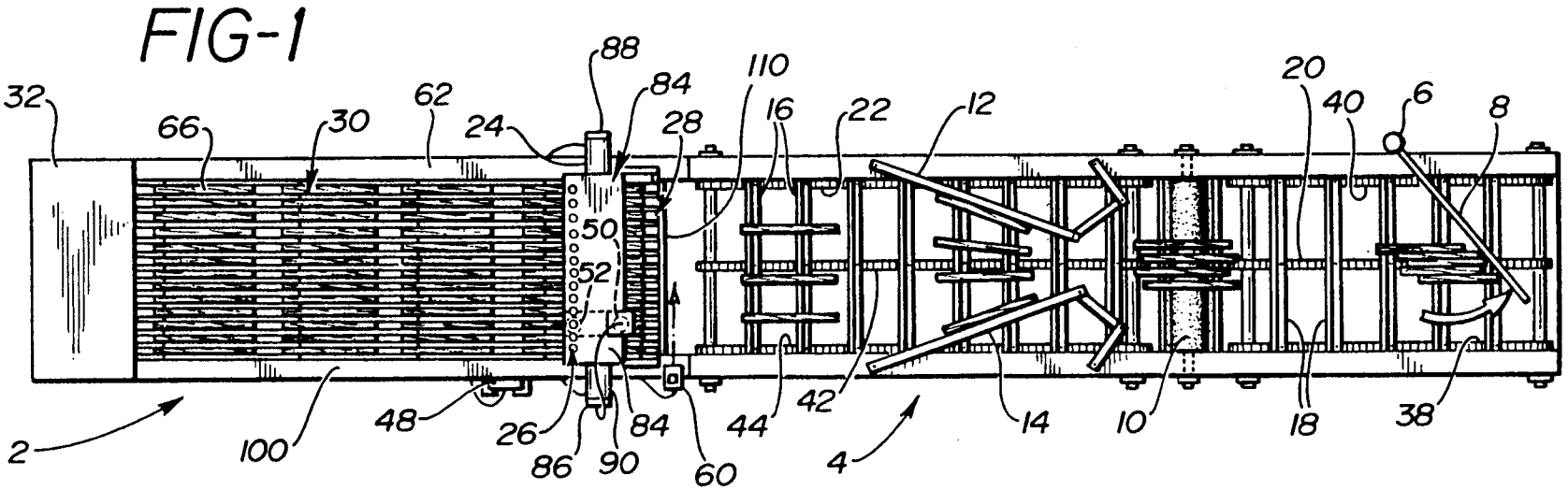
FIG. 1 is a top view of the apparatus of the invention.

FIG. 1 is a top view of the apparatus employed in the invention. FIG. 1 consists of two main sections; an infeed section 2 is provided to the left of FIG. 1 which includes infeed table surface 32. The infeed table surface 32 serves as a working surface which enables the operator to stack pieces of wood in thirteen separate tracks shown generally at 30. The operator has available to him a hand held push button controller 48. When the operator has filled the tracks 30 with pieces of wood, the operator depresses the push button on controller 48 to activate the apparatus. The thirteen tracks each may contain a number of uniform length, uniform thickness but not non-uniform width pieces of wood. These thirteen tracks extend along the length of the frames supporting infeed section 2 until they pass beneath a scanner section shown generally at 84.

Each of the thirteen tracks 30 end in respective ones of thirteen gates shown generally at 28 in FIG. 1. The gates permit a number of selected boards to pass on to the second main section of the apparatus, the output section 4.

This scanner section is followed by an outfeed section shown generally at 4. The outfeed section takes the selected boards from the gates and conveys them to a work station after passing the boards through a concentrator. The concentrator consists of rails 12 and 14 which serve to concentrate and compress the boards into a compact arrangement and may be located centrally of the outfeed section 4. The boards thus concentrated are in turn passed over the glue roller 10. Glue is applied to the boards by roller 10 on one edge thereof and are then conveyed to a wand 8 which acts as a stop wand or feeler. Wand 8 is pivoted about a spring-loaded pivot mounting 6. Movement of the wand to the position shown in FIG. 1 stops the apparatus. Release of the wand from the position shown in FIG. 1 permits the apparatus to operate. The wand 8 is caused to release from the position shown in FIG. 1 when the bundle of boards which has caused the wand to move its "off" position as shown in FIG. 1 is removed by the operator for further processing.

The outfeed section 4 of FIG. 1 includes a number of rotatable roller rails 16. These roller rails 16 are chain-driven by chains 22, 44 and 42 in FIG. 1. The set of roller rails 16 conveys the boards from the gates 28 through the concentrators 12 and 14. Another set of roller rails 18 controlled by chain drives 38, 40 and 20 take the boards from the glue roller 10 to the end of the apparatus at stop wand 8.

Figure 2:
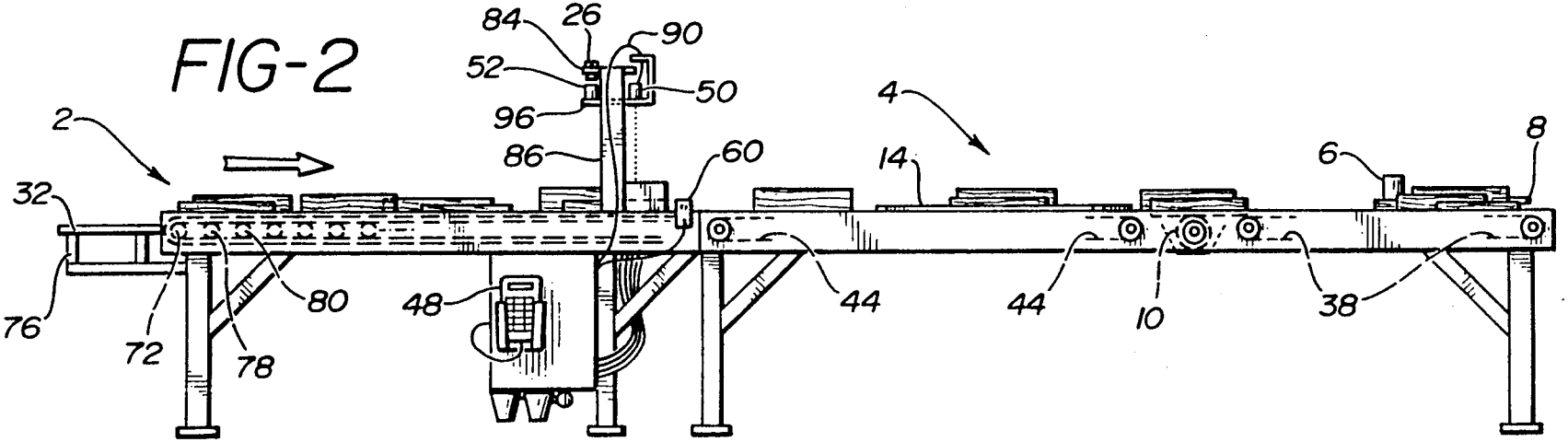
FIG. 2 is a side view of the apparatus.

As shown in FIG. 2, a side view of the apparatus of FIG. 1, infeed table surface 32 is connected to the thirteen rails in conveying section 2 of the apparatus.

FIG. 2 also shows a keyboard 48 with a liquid crystal display. The keyboard 48 is mounted on a panel adjacent the scanning section. This keyboard allows the scanning apparatus to be set with selection parameters which will be described in connection with the computer program by which the apparatus operates as further described in connection with FIGS. 9 and 10 hereof.

Figure 5:
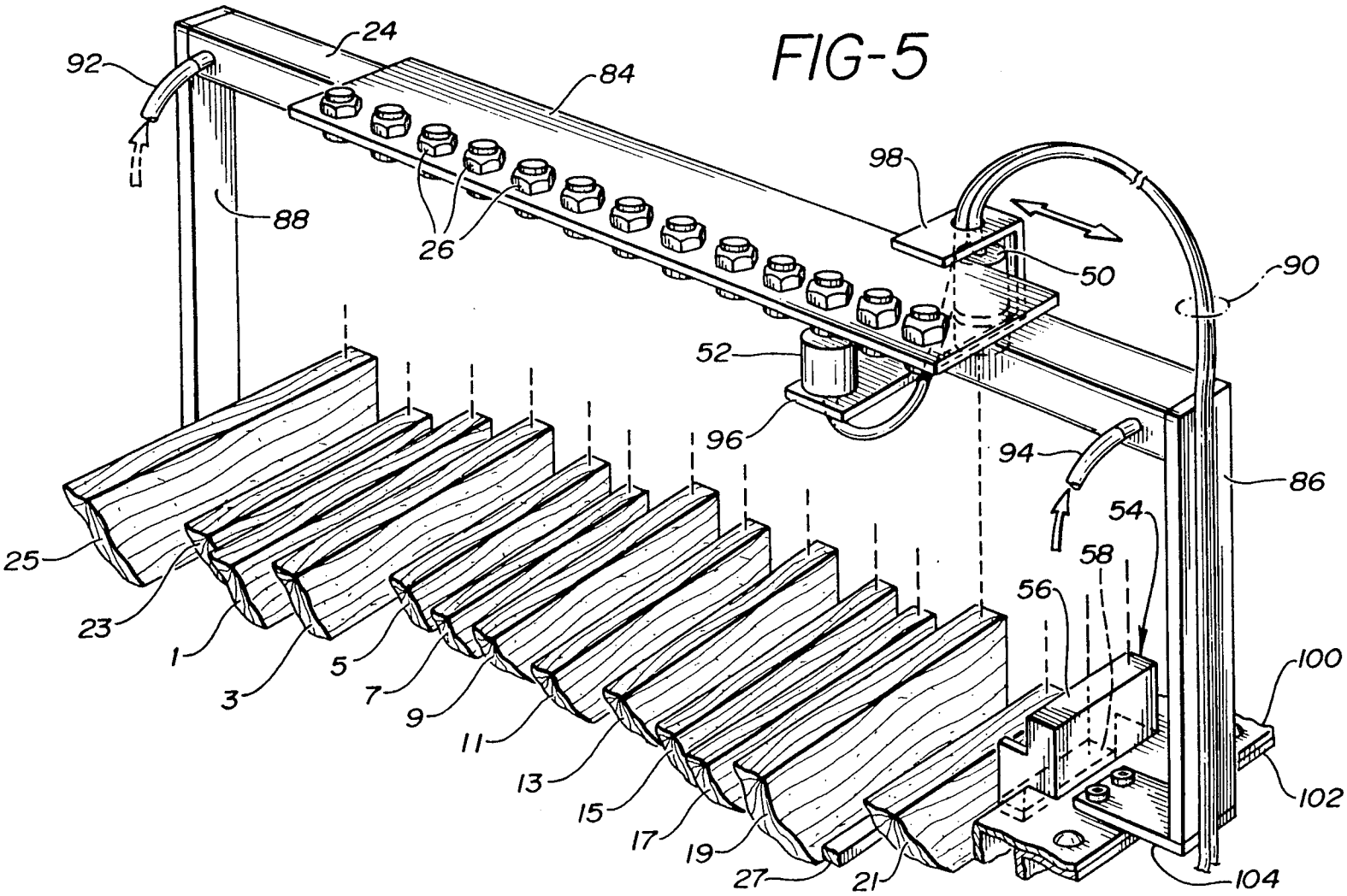
FIG. 5 is a perspective view partially in section of the scanning subsystem of FIGS. 1 and 2.

The side view of FIG. 2 also shows a plurality of sets of boards located at various points along the apparatus. Also shown in FIGS. 2 and 5 is a vertical support bar 86 which mounts the scanner section of the apparatus. The scanner section consists of an ultrasonic analog scanner 50 and a digital proximity sensor 52. Each of these scanners are mounted on a supporting bracket 96 which is, in turn, mounted to a rodless cylinder 24. As is known in the art, a rodless cylinder is an air-driven device which allows a carriage to move from one side of the apparatus to the other. This is commercially available apparatus identified as model BC100-1P×30" manufactured by Tolomatic and is employed in the present invention to move the scanners 50 and 52 across the entire width of the thirteen channels 30. The rodless cylinder is mounted on bracket supports 86 and 88. A plate 84 is mounted on the top of the rodless cylinder 24. Plate 84 has thirteen stopnuts shown generally at 26 mounted therein. The stopnuts 26 provide an indication of location by proximity to sensor 52. The analog proximity sensor 50 develops electrical signals based on ultrasonic detected signals indicative of the width (height in FIGS. 2 and 5) of each of the boards. The digital proximity sensor 52 detects which channel the analog sensor is measuring by a count of pulses indicative of sensing its proximity to the stopnuts 26. More particularly, a count from one to thirteen is developed as the proximity sensor 52 moves across the rodless cylinder 24 from one end to the other.

Figure 6:
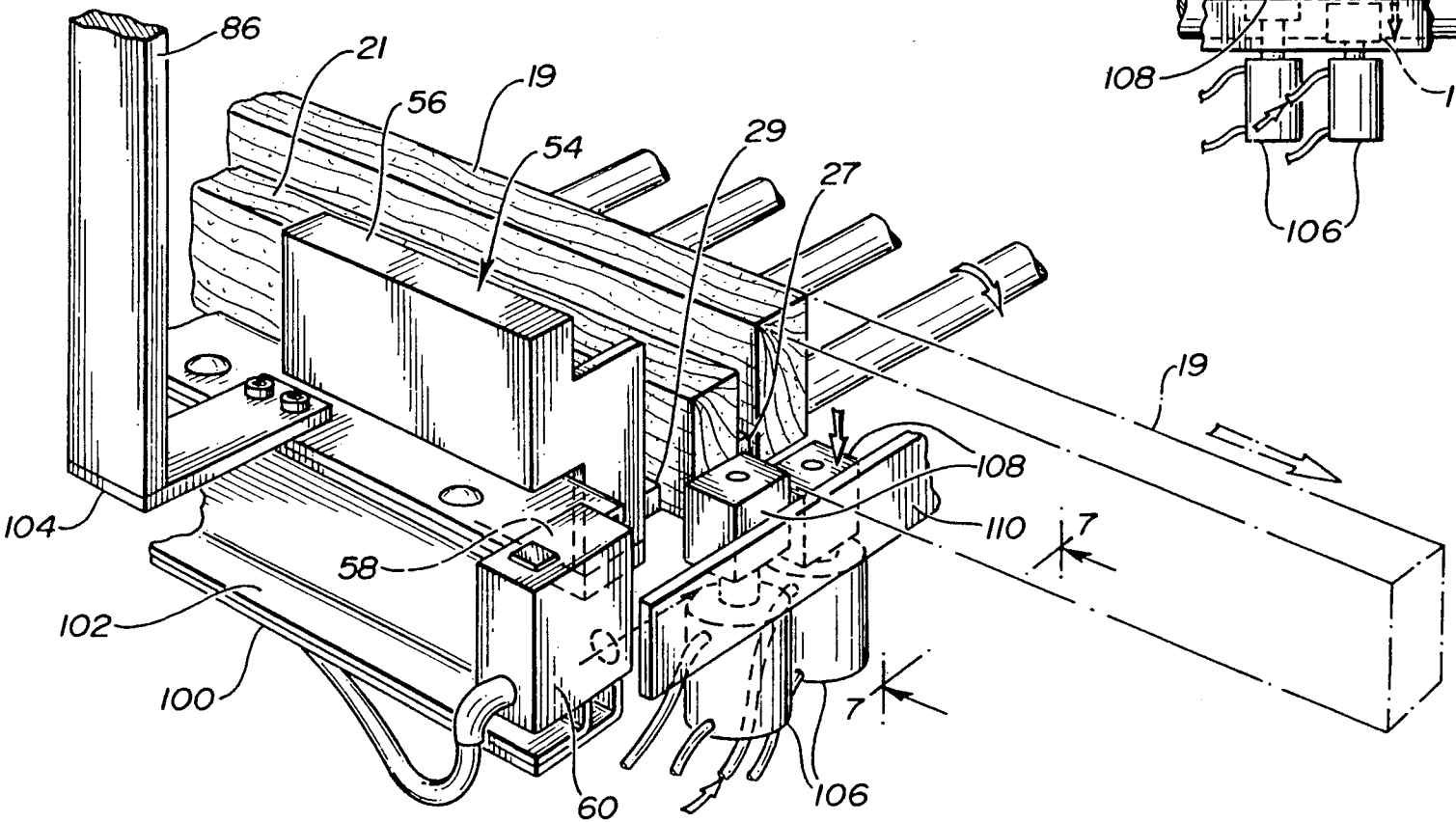
FIG. 6 is a perspective view partially in section of a portion of the gating subsystem of the invention.

As shown in FIGS. 1, 2 and 6, an electric eye circuit 60 is provided to generate a signal indicative of boards passing in the path of the electric eye 60. Numeral 90 denotes the electrical lead wire connecting the sensors 50 and 52 to the computer portion of the apparatus.

Figures 3, 4:
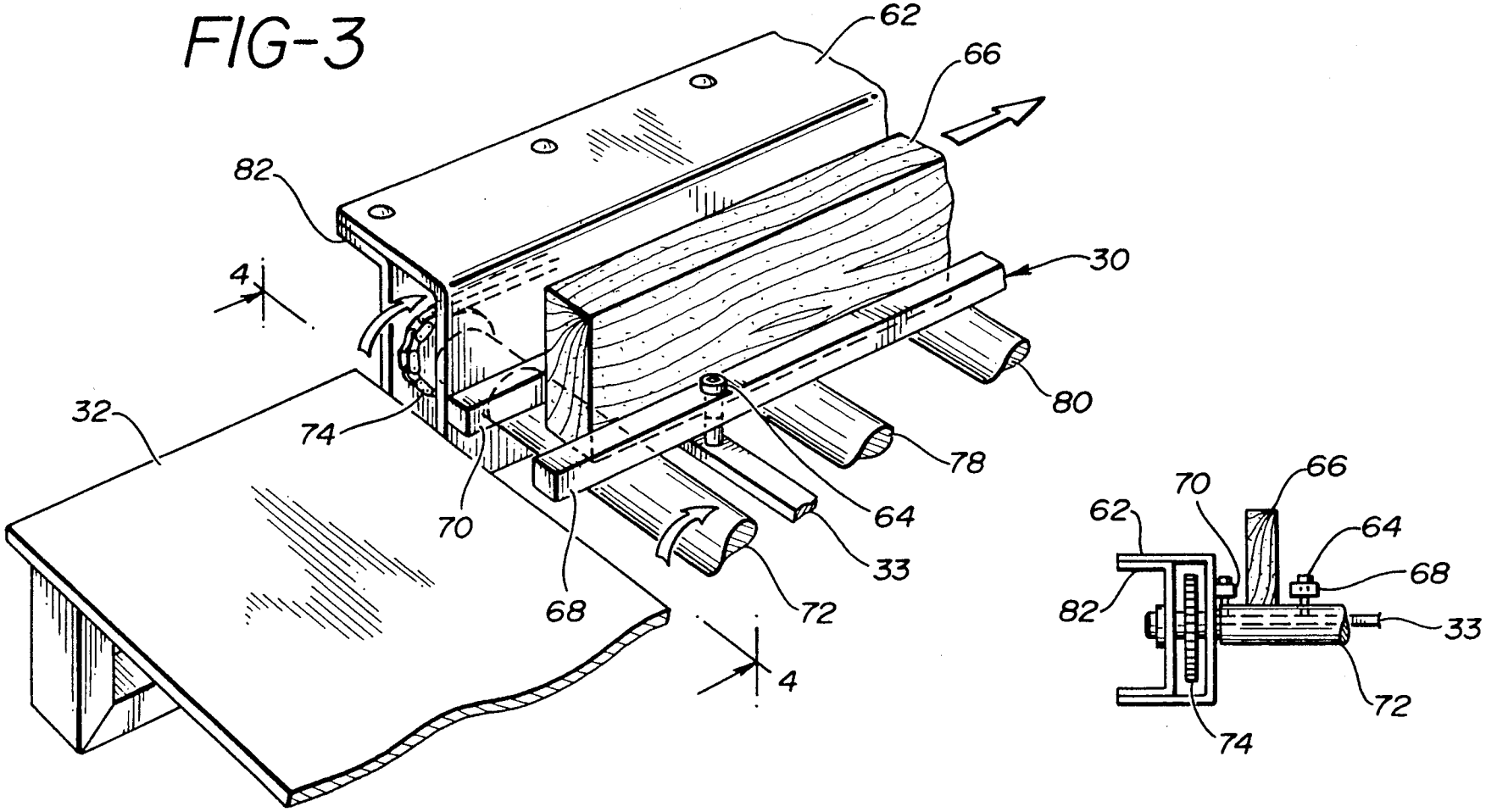
FIG. 3 is a perspective view partially in section of the infeed portion of the apparatus shown in FIGS. 1 and 2.
FIG. 4 is an end view of a portion of the apparatus shown in FIG. 3, taken along the line 4—4 of FIG. 3.

FIG. 3 shows the infeed section of the apparatus of FIGS. 1 and 2 in more detail. In FIG. 3, the infeed table 32 is mounted on a support bracket 76. One of the thirteen wood feeding tracks is shown in FIG. 3. This track is formed between rails 68 and 70. A piece of wood 66 is shown edge-mounted between the rails 68 and 70. The rails 68 and 70 are fastened to lateral frame supports such as 33 by a mounting fastener suitable to the materials of which the rail 68 and the support 33 is formed such as shown generally at 64. A chain drive is shown at 74 and serves to rotate roller rails such as 72, 78 and 80 to convey the wood piece 66 along the length of the infeed rail structure. As shown in FIGS. 3 and 4, the structural support is provided by two complimentary U-shaped brackets 62 and 82. These brackets serve to provide structural integrity for the infeed section as well as to provide a safe protected covered housing for the chain drive 74.

FIG. 5 shows the scanning section of the invention. As will now be seen, thirteen boards of uniform length and thickness but different widths are presented beneath the scanning section. These boards are designated by numerals 1, 3, 5, 7, 9, 11, 13, 15, 17, 19, 21, 23 and 25. The boards are located beneath the two scanners: the analog scanner 50 and the digital scanner 52. The scanners 50 and 52 are mounted on the rodless cylinder 24. The rodless cylinder is coupled to the scanners via scanner mounting bracket 98, 96. This bracket consists of U-shaped portions having a short leg 98 and a long leg 96. Proximity digital sensor 52 is mounted on leg 96 and analog sensor 50 is mounted between leg 96 and short leg 98. As is known in the art, rodless cylinder 24 is coupled to the bracket 96,98 and, under control of air lines 94 and 92, serves to slide bracket 96, 98 from one side of cylinder 24 to the other at a uniform rate. There is also mounted on rodless cylinder 24 a mounting plate 84 which contains the thirteen stopnuts shown generally at 26. It is these stopnuts that cooperate with and are sensed by the proximity sensor 52 so that actual signals indicative of the count of each stopnut from one through thirteen are developed for each scan of the sensors 52 and 50 across rodless cylinder 24. The rodless cylinder 24 is in turn mounted on the remaining apparatus by vertical supports 86 and 88. The brackets 86 and 88 are coupled to support rails 100 and 102 in FIG. 5 and 62 and 82 in FIGS. 3 and 4 (for support 88) via a bar such as 104 which is fastened to rail 100.

An important feature of the invention is shown in FIG. 5 as calibration block or gauge block 54. This gauge block contains two surfaces, a top surface 56 and a lower surface 58 located coincident with the level of the surface of the rails (one rail is shown in FIG. 5 at 27). As will be explained later, analog ultrasonic sensor 50 utilizes these surfaces as calibration surfaces for the scan so as to gauge the range of widths of the pieces of wood.

FIG. 6 shows the gauge block 54 in more detail. In FIG. 6, the gauge block is viewed from the end opposite that shown in FIG. 5 so that two of the thirteen gates are also seen in this showing. More particularly, FIG. 6 shows the mounting bracket supports 104 and 86 for the scanning section. These brackets are connected to support rails 102, 100 as discussed in connection with FIG. 5. The gauge block 54 has a top surface 56 and bottom surface 58 formed therein. Two pieces of wood 19 and 21 are shown in FIG. 6 having arrived at the end location for the infeed section of the apparatus. Electric eye 60 is mounted to support rails 102, 100.

Figure 7:
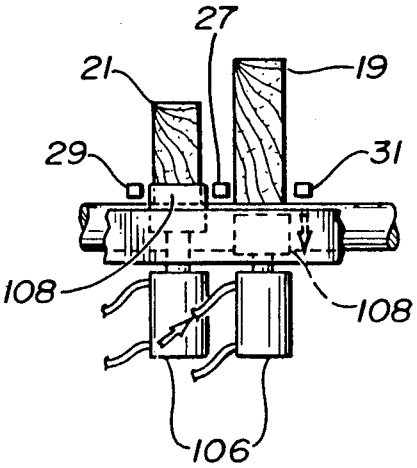
FIG. 7 is an end view taken along the line 7—7 of FIG. 6 of a portion of the gating system of the invention.

Each of the thirteen channels are controlled by gates which consist generally of a solenoid operated air cylinder 106 and a movable gate element 108 mounted to the air cylinder. When the cylinder is actuated, the element 108 is caused to drop down from the position shown in FIGS. 6 and 7 applicable to board 21 to the lower position shown in FIGS. 6 and 7 applicable to board 19. This allows the board 19 to advance to the next station. In FIGS. 6 and 7, numerals 27, 29 and 31 denote the support rails for the channels in which boards 21 and 19 are carried. The cylinders are mounted on and supported by mounting plate 110.

Figure 8:
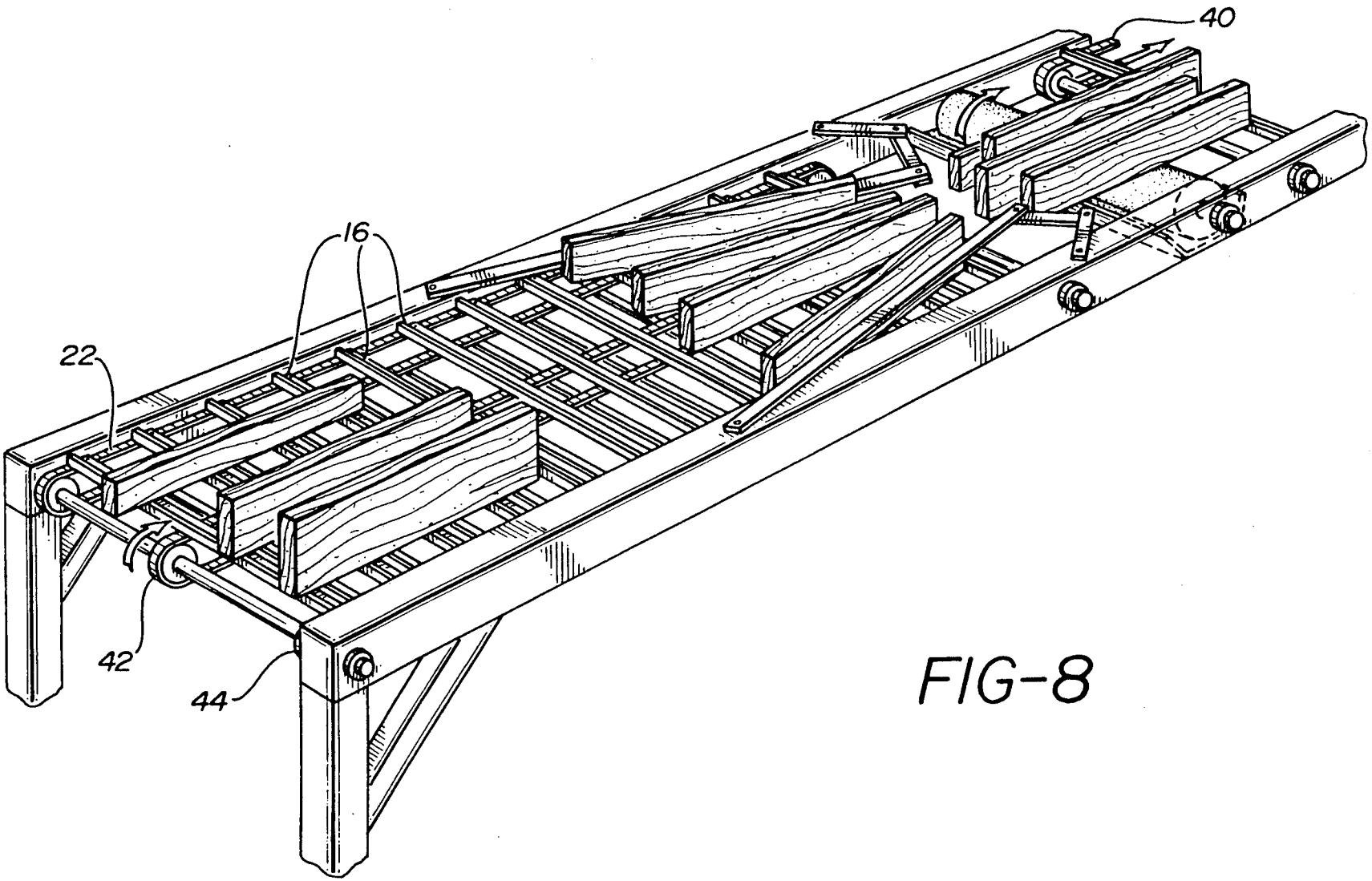
FIG. 8 is a perspective view partially in section of the outfeed apparatus of the invention.

FIG. 8 shows the outfeed portion of the apparatus. FIG. 8 shows three groups of boards progressing from the gates 108 through the glue roller 10. As shown, the boards are concentrated by two rails 12 and 14 which are mounted such that the boards are caused to move closer to each other before they pass over edge-gluing roller 10. Numeral 40 denotes one of the chain drives for the roller rails employed in the section of rails downstream of the glue roller 10 and chain drives 22, 42 and 44 operate the section of rails 16 located upstream of the glue roller 10.

Figure 9:
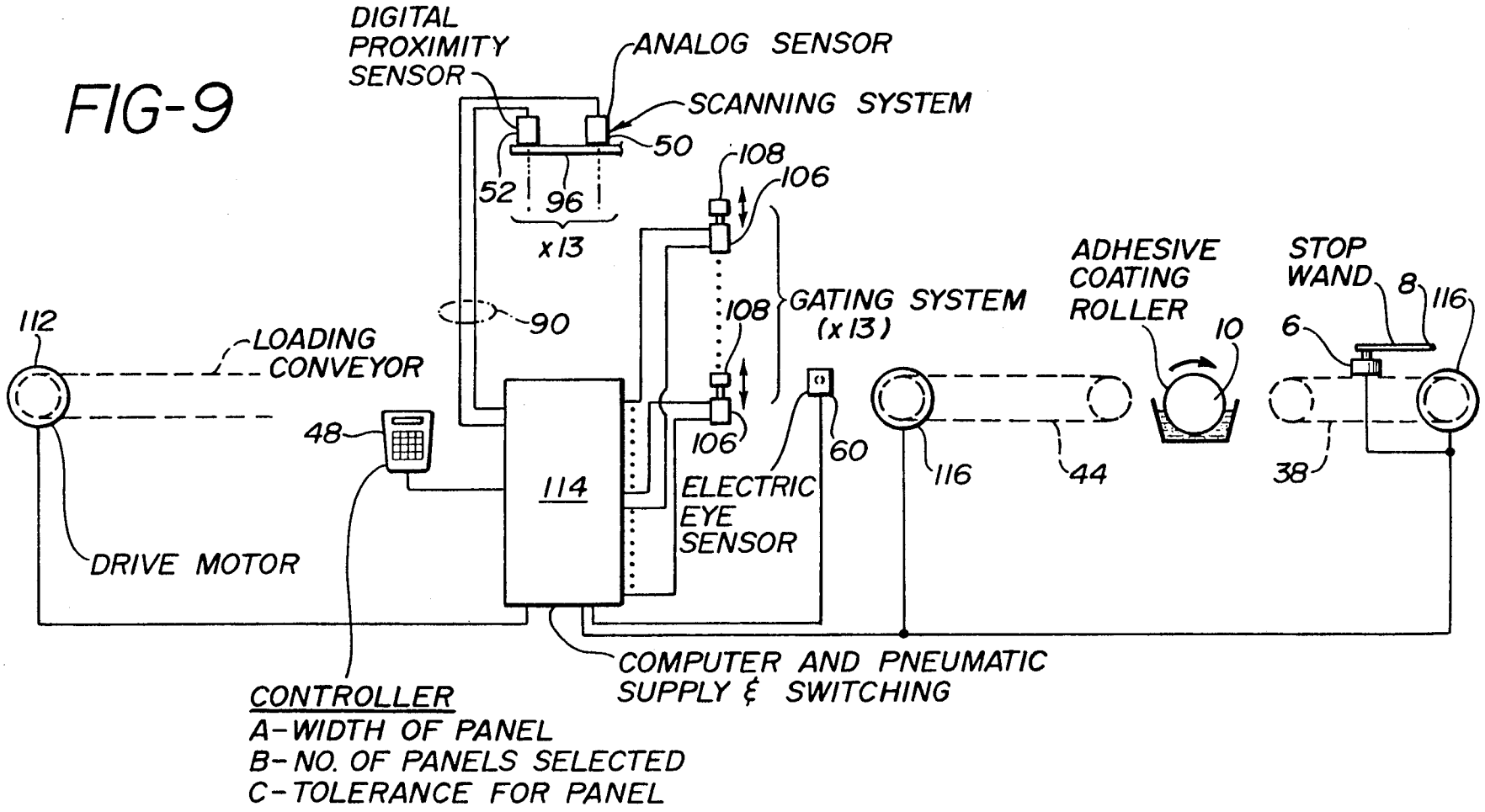
FIG. 9 is a diagrammatic view of the connections amongst the various subsystems in the invention.

FIG. 9 is a diagram which shows the electrical connections of the various elements previously described in connection with FIGS. 1–8. The apparatus employs drive motors 112 and 116. Motor 112 operates infeed section 2. Motor 116 controls the glue roller 10, the intermediate section roller rails 16 upstream of glue roller 10 and the rails 18 downstream on controller 48 of glue roller 10. A push button on controller 48, described in connection with FIG. 2 above, causes the apparatus to start, stop and scan under control of the operator. The controller 48 permits the operator to select the width of the panel to be formed by the pieces, the number of pieces to be selected and the tolerance applicable to the selection. These signals are fed to computer 114. Computer 114 also receives as inputs, the outputs of digital proximity sensor 52 and analog sensor 50 from the scanning system. The computer 114 is also connected to receive the input of the electric eye sensor 60. The computer controls the gates 106, 108 to select the boards for passage to glue roller 10 until de-energized by stop wand 8 on mounting pivot 6. A printer 200 is connected to computer 114.

The following table shows the manufacturer and model number of each of the elements of FIG. 9:

Computer 114—Wintek 6809 Control Computer
Controller 48—Quartic Systems QTERM-HR1
Electric eye sensor 60—Sunx NX-52M Beam Sensor
Digital proximity sensor 52—Microswitch 923AA4W-ATT-L
Analog sensor 50—Agastat PCU-A-30-M-30-AV
Gates 106,108—Bimba I91-D 1-1/16 bore×1" stroke In practice, the number of thirteen different tracks from which the desired number of boards is to be selected was empirically derived. The number of boards required to make up a panel of the desired thickness could be more or less than thirteen depending on the variations in the output panel size desired and the size of the input stock from which the panel is to be formed.

With respect to maximum and minimum sizes, in operation, Applicant has found that the boards can vary in size from one inch to six inches in width (height when used in the apparatus).

The scanning section can select panels of any total width even wider than 13"×6". The selector accomplishes this by making a number of runs. For example, if a panel of 200" is desired, even though the apparatus provides only thirteen pieces of a maximum 6" height, three separate runs would be performed. On the first run, all the boards would be selected. On the second run, again all the boards would be selected. On the third run, the number of boards necessary to give a total number of 200" would be selected.

Figure 10:
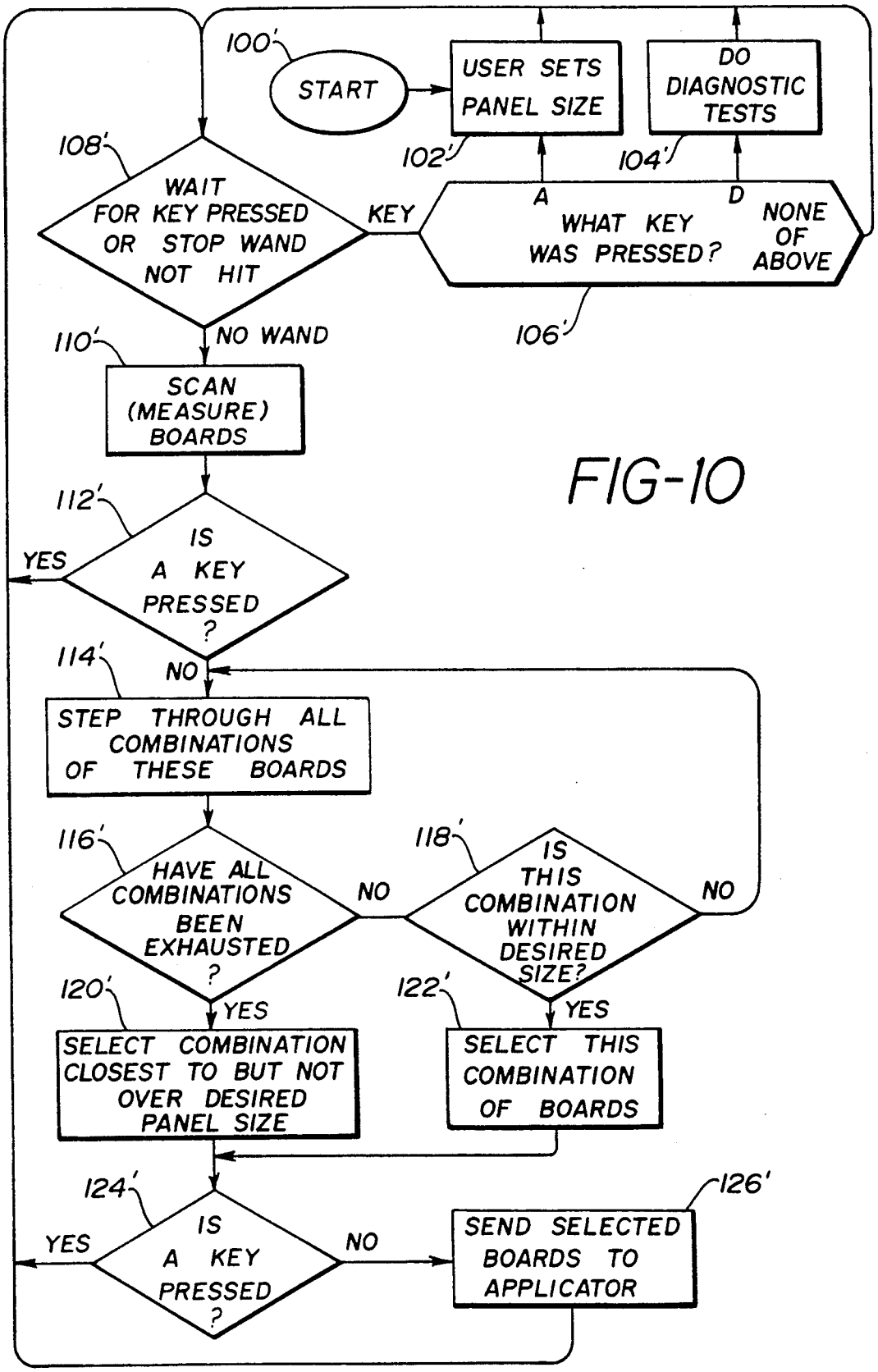
FIG. 10 is a flow chart for the computer program employed in the invention.

If the scanning cannot select boards within the desired tolerance (for example, 15"+ or −1/32") then it selects the combination that is closest to and larger than the desired size. The flow chart for the program described below is shown in FIG. 10 hereof. The computer program for controlling the apparatus is set forth below.

The program instructions for printing the information concerning operations of the apparatus are in the lines labeled, "PRINTER OUTPUT". These instructions print information consisting of customer code, panel width, length, thickness, number of panels and number of boards. The information regarding production totals can also be printed.

The program instruction for generating a count alarm to stop the machine when a preset number of panels are produced are labeled, "COUNT ALARM IS REACHED".

```
#include 'psio.h'

int used[22],scandir;
int boardsize[22];
unsigned int outstatus,outstat2;
int numslots,numslotplus1;
int maxboards,boardssent,maxboardsperpanel;
int ccode,zerocount,releasecount,rescan;
long sizeleft;
int metric; /*** will be set to one if working in metric (input #4) ***/

/*** Version 1.8  allows 1st and last slots to be left empty ***/
/*** Note: Versions 1.7 and greater allow the user to program in the maximum number ***/
/*** of boards per panel.  The program simply rejects any combination   ***/
/*** with too many boards.  If there is no combination, it sends the    ***/
/*** closest size if it is within maximum tolerance                     ***/

main()
   {
   long size,lastsize,length=0,thick=0,totpanels=0,numboards=0,totboards=0;
   float totsqft=0.0,tottbdft=0.0,floatdum;
   int tolerance;
   int maxtol=9999;
   long longinput();
   int numpanels=0;
   int mode=0,alarm=0;

   char c,custcode[16];
   custcode[0]='\0';
```

```
   ccode=500;
   scandir=0;
   maxboards=99;
   maxboardsperpanel=99;
   rescan=1;

   ioinit();
   printl(1,'Startup');
   /*** set metric flag ***/
   if (sense(4))
      {
      metric=1;
      tolerance=76;
      }
   else
      {
      metric=0;
      tolerance=30;
      }
   while (ischar()) inchar();
   size=longinput((long)0,6,3-metric,'Enter Panel Size');
   if (isprint())
      {
      length=longinput(length,6,3-metric,' Enter Board\n   Length');
      thick=longinput(thick,5,3-metric,' Enter Board\n Thickness');
      }
   if (isprint()) printl(2,'\n   Job Data       Totals\n---------------  ------\n');
   if (size==98989) adccal();
   lastsize=size;
   sizeleft=0;
   setnumslots();
again:
   cls();
   printl(1,'V2.6  Count:');
   printint(1,numpanels);
   printl(1,'\nPanelsize:');
   printlong(1,lastsize,5,3-metric,' ');
   printl(1,'\nA-Panel Size\nB-Menu 2 (other)');
   /*** Check for a key pressed ***/
      if (ischar() || numslots==0)
         {
         if (numslots!=0) c=inchar();
         while (ischar()) inchar(); /*** flush buffer ***/
         if (c=='A')
            {
            if (isprint() && numpanels>0)
               {
               cls();
               printl(1,'\n  Printing...\n  Please Wait');
               if (custcode[0]!='\0')
                  {
                  printl(2,'Code:');
                  printl(2,custcode);
                  printl(2,'\n');
                  }
               printl(2,'Width : ');
               printlong(2,size,6,3-metric,' ');
               printl(2,'\nLength: ');
               printlong(2,length,6,3-metric,' ');
               printl(2,'\nThick : ');
               printlong(2,thick,6,3-metric,' ');
               printl(2,'\nPanels: ');
               totpanels+=numpanels;
               printlong(2,(long)numpanels,7,0,' ');
               printlong(2,totpanels,8,0,' ');
               printl(2,'\nBoards: ');
               totboards+=numboards;
               printlong(2,(long)numboards,7,0,' ');
               printlong(2,totboards,8,0,' ');
               if (metric)
                  {
                  floatdum=(size/100000.0)*(length/100000.0)*numpanels;
                  printl(2,'\nSq.Mt.: ');
                  }
```

Printer output

Printer output

```
            else
               {
               floatdum=(size/12000.0)*(length/12000.0)*numpanels;
               printl(2,'\nSq.Ft.: ');
               }
            totsqft+=floatdum;
            printlong(2,(long)(floatdum),7,0,' ');
            printlong(2,(long)(totsqft),8,0,' ');
            if (metric)
               {
               floatdum*=thick/100000.0;
               printl(2,'\nCu.Mt.: ');
               }
            else
               {
               floatdum*=thick/1000.0;
               printl(2,'\nBd.Ft.: ');
               }
            totbdft+=floatdum;
            printlong(2,(long)(floatdum),7,0,' ');
            printlong(2,(long)(totbdft),8,0,' ');
            printl(2,'\n---------------\n');
            }
         lastsize=size;
         size=longinput(size,6,3-metric,'Enter Panel Size');
         if (isprint())
            {
            length=longinput(length,6,3-metric,' Enter Board\n   Length');
            thick=longinput(thick,5,3-metric,' Enter Board\n Thickness');
            }
         alarm=0;
         numpanels=0;
         numboards=0;
         lastsize=size;
         sizeleft=0;
         rescan=1;
         }
      else if (c=='B' || numslots==0)
         {
         cls();
         printl(1,'A-Tolerances\nB-Diagnostics\nC-Extras\n');
         while (!ischar());
         c=inchar();
         if (c=='A')
            {
tolmenu:
            cls();
            printl(1,'A-Initial Tol.\nB-Maximum Tol.\nC-Boards/Batch\nD-Boards/Panel');
            while (!ischar());
            c=inchar();
            if (c=='A')
               {
               tolerance=longinput((long)tolerance,3,3-metric,'Enter Tolerance');
               goto tolmenu;
               }
            else if (c=='B')
               {
               maxtol=longinput((long)maxtol,4,3-metric,'Enter Maximum\n  Tolerance');
               goto tolmenu;
               }
            else if (c=='C')
               {
               maxboards=longinput((long)maxboards,2,0,'Enter Maximum #\nBoards/Batch');
               goto tolmenu;
               }
            else if (c=='D')
               {
               maxboardsperpanel=longinput((long)maxboardsperpanel,2,0,'Enter Maximum #\r
               goto tolmenu;
               }
            }
         else if (c=='B')
            {
```

```
diagmenu:
            cls();
            printl(1,'# of Slots: ');
            printint(1,numslots);
            printl(1,'\nA-Input/Output\nB-Measurements\nC-Diagnostics');
            while (!ischar());
            c=inchar();
            if (c=='A')
               /* Display status of inputs */
               {
               showinputs();
               goto diagmenu;
               }
            else if (c=='B')
               /*** Display individual board sizes ***/
               {
               showsizes();
               goto diagmenu;
               }
            else if (c=='C')
               /* perform diagnostic tests */
               {
               diagnostics();
               rescan=1;
               goto diagmenu;
               }
            }
         else if (c=='C')
            {
extramenu:
            cls();
            printl(1,'A-Production Code\nB-Count Alarm\nC-Aplicator Mode');
            while (!ischar());
            c=inchar();
            if (c=='A')
               {
               stringinput(custcode,16,'     Enter\nProduction Code');
               goto extramenu;
               }
            else if (c=='B')
               {
               alarm=longinput((long)alarm,4,0,'    Enter\nAlarm Point');
               goto extramenu;
               }
            else if (c=='C')
               {
               cls();
               printl(1,'Applicator Mode:\n\nHit Enter\nto exit.');
               while (!ischar())
                  {
                  if (sense(STOPWAND)) outon(APPLICATOR);
                 else outoff(APPLICATOR);
                 }
               outoff(APPLICATOR);
               while (ischar()) inchar();
               }
            }
         }
      }
   else if (size!=0)
      {
      /*** Try to make a panel ***/
      c=makepanel(size,tolerance,maxtol);
      if (c!=0)
         {
         numboards+=c;
         lastsize=size-sizeleft;
         if (++numpanels==alarm)
            {
            cls();
            printl(1,'Alarm Count of\n');
            printint(1,alarm);
            printl(1,' has been\nreached. Hit any\nkey to continue.');
```

Machine Stops if Count Alarm is Reached

```
                while (!ischar())
                   {
                   if (sense(STOPWAND)) outon(APPLICATOR);
                   else outoff(APPLICATOR);
                   }
                outoff(APPLICATOR);
                while (ischar()) inchar();
                }
             }
          }
       goto again;
       }
   ????????????????????????????????????

#include 'psio.h'

int scanboards(metric)
   int metric;
   /*** number of unmeasureable boards is returned
    *** If metric=1, sizes are returned in mm*100, otherwise in inches*1000
    ***/
   {
   extern int boardsize[22],numslots,numslotplus1;
   extern int scandir,rescan;
   int dummy,zerocount=0;
   float gage1,gage6,fargage1,fargage6,g1,g6,dumboard;
   /*** read values ***/
scanagain:
      rescan=0;
      scanstart();
      if (scandir)
         {
         fargage6=readsize(1);
         fargage1=readsize(0);
         for (dummy=numslots;dummy>=1;--dummy)
            boardsize[dummy]=readsize(0);
         gage1=readsize(0);
         gage6=readsize(1);
         }
      else
         {
         gage6=readsize(1);
         gage1=readsize(0);
         for (dummy=1;dummy<=numslots;++dummy)
            boardsize[dummy]=readsize(0);
         fargage1=readsize(0);
         fargage6=readsize(1);
         }

    /*** if gageblock value is out of range, scan again ***/
    if (gage6<650 || gage6>1250 || fargage6<650 || fargage6>1250 ||
        gage1<3350 || gage1>3950 || fargage1<3350 || fargage1>3950)
       {
       cls();
       printl(1,'Gage block\nmeasurement\nerror');
       delay(1000);
       rescan=1;
       if (ischar()) return(-1);
       goto scanagain;
       }
   /*** convert boardsize numbers to inches using ***/
   /*** gage blocks for auto calibration.         ***/
      for (dummy=1;dummy<=numslots;++dummy)
          {
          g1=((numslotplus1-dummy)*gage1+dummy*fargage1)/(float)numslotplus1;
          g6=((numslotplus1-dummy)*gage6+dummy*fargage6)/(float)numslotplus1;
          dumboard=1.0+5.0*((g1-boardsize[dummy])/(g1-g6));
          if (dumboard<.8)
             {
             boardsize[dummy]=0;
             if (dummy>1 && dummy<numslots) ++zerocount;
             }
          else
             {
```

```
            if (metric) dumboard*=2.54;
            boardsize[dummy]=dumboard*1000;
            }
        }
  return(zerocount);
  }


int readsize(sel)
   int sel;
   /*** Returns the size (voltage) of one board.      ***/
   /*** This routine assumes the sensor is traversing ***/
   /*** Look for down slope, then min value, then up slope ***/
   /*** The min value must be in a flat zone. ***/
   /*** if sel==1, will return min value regardless of slopes ***/
   {
   int flat=0,minnoup=32000,minup=32000,x,down=sel,y=0,xmin=32000;
   /*** within any one flat zone, a minimum value first goes into
        minnoup.  On an upslope, either in the flat zone or at the
        end of the flat zone, it may go into minup.  Finally at the
        end of the flat zone or at the end of the scan, it may go
        into xmin which will be returned. ***/

   down=sel;
   /*** Get off of delimeter ***/
   while (!sense(DELIMETER));
   /*** Traverse until next delimeter ***/
   while (sense(DELIMETER))
      {
      x=getadc();
      if (x<y) down=1; /*** set flag on first down slope ***/
      if (x>y || sel) /*** upslope ***/
         {
         if (minnoup<minup) minup=minnoup;
         }
      if (x-y<15 && y-x<15) /*** flat ***/
         {
         ++flat;
         /*** keep track of minimum within this flat zone.  A minimum is
              only valid if a down slope has occured ***/
         if (x<minnoup && down) minnoup=x;
         }
      else  /*** not flat ***/
         {
         /*** This can be the minimum if all of the following are true:
          *** - it has been flat for at least five readings.
          *** - it is less that the previous minimum.
          *** - there was a down slope before the minimum. (checked in minnoup)
          *** - there was an up slope after the minimum. (checked in minup)
          ***/
         if (flat>4 && minup<xmin) xmin=minup;
         flat=0;
         minnoup=32000;
         minup=32000;
         }
       y=x;
       }
    if (flat>4 && minup<xmin) xmin=minup;

    return(xmin);
    }

????????????????????????????????????????????????????????????????????????
                                                          ~


/*** Terminal Specific commands for Quartic Qterm ***/

cls()
   {
   printl(1,"\033E");
   delay(200);
   }
```

```
printat(x,y)
   int x,y;
   {
   printl(1,'\033l');
   putchar((char)(47+y*16+x));
   }

beep();
????????????????????????????????????

showsizes()
   /*** displays the sizes of individual boards ***/
   {
   extern int boardsizeL22],numslots,metric;
   int dummy;

   cls();
   printl(1,'Enter 0 to scan,\nSlot number, or\nENTER to quit.\n');
again:
   while(!ischar());
   dummy=inchar();
   if (dummy>=48 && dummy<=57) dummy-=48;
   if (dummy>=65 && dummy<=76) dummy-=55;
   if (dummy>numslots) return;
   if (dummy==0) scanboards();
   else
      {
      printat(1,4);
      putchar('#');
      printint(1,dummy);
      putchar('=');
      printlong(1,(long)boardsize[dummy],6,3-metric,' ');
      printl(1,'    ');
      }
   goto again;
   }
??


#include 'psio.h'

extern int numslots,numslotplus1;

setnumslots()
   /*** scans and counts delimeters, then sets numslots ***/
   /*** and numslotspp ***/
   {
   int state,count,time;

   cls();
   printl(1,'Setting number\nof slots.');
   count=-1;
   scanstart();
   if (sense(DELIMETER))
      {
      printl(1,'Delimeter Sensor\nout of position.\nRestart Machine.');
      while(1);
      }
   do {
      time=0;
      state=sense(DELIMETER);
      while (state==sense(DELIMETER) && (++time<4000 || (time<10000 && count<11)));
      }
      while (++count<12 || time<4000);
   if ((count/2)*2!=count || count<28) /*** odd # of transitions ***/
      {
      telluser('Error counting\nslots.  Hit\nany key.');
      numslots=0;
      numslotplus1=0;
      }
   else
      {
      numslots=(count-8)/2;
```

```
      numslotplus1=numslots+1;
      }
   }
???????

/* misc. routines */

#include 'psio.h'

int waitstart()
   /* Waits for start button off, then on again, or a key is pressed */
   {
   while (ischar()) inchar();
   while (!ischar());
   inchar();
   }

int delay(time)
   /* Delays for time miliseconds */
   int time;
   {
   int dummy,d2;
   for (dummy=1;dummy<=time;++dummy)
      for (d2=1;d2<=30;++d2);
   }

int scanstart()
   /* Start scan cyl. traversing in opposite direction */
   {
   extern int scandir;
   scandir=!scandir;
   if (scandir) outon(SCANCYL);
   else         outoff(SCANCYL);
   }

int cyl(x)
   int x;
   /*** translates outputs as follows:
    ***  0 --> 16
    ***  1 --> 1
    ***    ...
    *** 13 --> 13
    *** 14 --> 17
    ***    ...
    *** 21 --> 24
    *** 22 --> 14
    *** 23 --> 15
    ***/
    {
    if (x==0) return (16);
    if (x<=13) return (x);
    if (x<=21) return (x+3);
    return (x-8);
    }
????????????
```

```
         if (i[dummy]) printl(1,'X ');
         else          printl(1,'O ');
         }
      u=getadc();
      putchar(' ');
      printint(1,u);
      printl(1,'    ');
      }
   /*** Check for key hit...Change output state ***/
      if (ischar())
         {
         dummy=inchar();
         if (dummy==13) dummy=100;
         if (dummy>=48 && dummy<=57) dummy-=48;
         if (dummy>=65 && dummy<=79) dummy-=55;
         if (dummy>24)
            {
            for (dummy=1;dummy<=24;++dummy)
               if (dummy!=16) outoff(dummy);
            return;
            }
         if (dummy==0 || dummy==16) scanstart();
         else
            if (ison(dummy)) outoff(dummy);
            else outon(dummy);
         }
   goto again;
   }
$$$
```

```
      count=0;
      cls();
      printl(1,'Bottom Screw:\n\n\n');
      while (count<20)
         {
         delay(50);
         x=getadc();
         if (x<4091)
            {
            printl(1,'Turn CW   \n');
            count=0;
            }
         else if (x>4094)
            {
            printl(1,'Turn CCW   \n');
            count=0;
            }
         else
            {
            printl(1,'  Good!    \n');
            ++count;
            }
         }
      }
   }
ΫΫΫ
```

```
stringinput(stg,length,prompt)
   /*** This function inputs a string with maximum length length and
    *** puts it into stg.  Characters are input until 'd' is hit.
    ***/
   char *stg,*prompt;
   int length;
   {
   int count=0;
   char c;
   cls();
   printl(l,prompt);
   printl(l,"\n\n");
   while (ischar()) inchar(); /*** clear buffer ***/
   while (1)
      {
      c=inchar();
      if (c=='d' || c=='\r')
         {
         *stg='\0';
         /*** fill with blank spaces ***/
         while (++count<=length)
            putchar(' ');
         return;
         }
      if (c=='\b') /*** backspace ***/
         {
         if (count>0)
            {
            putchar(c);
            --stg;
            --count;
            }
         }
      else if (count<length) /*** add this character ***/
         {
         ++count;
         putchar(c);
         *stg=c;
         ++stg;
         }
      }
   }
??????????????
```

```
/*** Before using these routines, outstatus has to be declared as
 *** an extern unsigned int outstatus=~0. (set equal to all ones).
 ***/

int outon(num)
   /*** Turns on output number num ***/
   int num;
   {
   if (num>16)
      output2(outstat2 &= ~(0x01 << (num-9)));
   else
      output(outstatus &= ~(0x01 << --num));
   }

int outoff(num)
   /*** Turn off output number num ***/
   int num;
   {
   if (num>16)
      output2(outstat2 |=(0x01 << (num-9)));
   else
      output(outstatus |=(0x01 << --num));
   }

int ison(num)
   /*** returns 1 if output num is on, otherwise returns 0 ***/
   int num;
   {
   if (num>16)
      return(!(outstat2 & (0x01 << (num-9))));
   else
      return(!(outstatus & (0x01 << --num)));
   }
int printl(port,stg)
   int port;
   char *stg;
   {
   int index=0;
   while (stg[index]!='\0')
      {
      if (port==2) prchar(stg[index]);
      else         putchar(stg[index]);
      ++index;
      }
   }

int printint(port,num)
   int port,num;
   /* prints a positive integer (num) */
   {
   char stg[15];
   char *ptr=stg+14;
   *ptr='\0'; /* end of string */
   do {
      *(--ptr)=48+num-(num/10)*10;
      num/=10;
      }
      while (num>0);
   printl(port,ptr);
   }

printlong(port,num,digits,decimals,blank)
   /*** prints a long number, using digits # of digits, puting a ***/
   /*** decimal decimals places from the end, and using blank    ***/
   /*** to fill all blank spaces ***/
   long num;
   int port,digits,decimals;
   char blank;
   {
   extern int metric;

   char stg[15];
   char *ptr=stg+14;
   int x;
```

```
    *ptr='\0';
    for (x=1;x<=digits;++x)
       {
       if (num==0)
          *(--ptr)=blank;
       else
          {
          *(--ptr)=48+num-(num/10)*10;
          num/=10;
          }
       if (x==decimals) if (metric) *(--ptr)=',' ; else *(--ptr)='.';
       }
    printl(port,ptr);
    }

 telluser(stg)
    char *stg;
    {
    cls();
    printl(1,stg);
    waitstart();
    }

 printfract(port,f,denom)
    float f;
    int port,denom;
    /*** prints a float number in fractional form with denom as the
         denominator (or a factor of it) ***/
    {
    int x;

    x=f;
    if (x>0)
       {
       printint(port,x);
       printl(port,' ');
       }
    f-=x;
    x=f*denom;
    while (x!=0 && (x/2)*2==x)
       {
       x/=2;
       denom/=2;
       }
    if (x!=0)
       {
       printint(port,x);
       printl(port,'/');
       printint(port,denom);
       }
    }
%%%
```

```
      numover=0,
      numb=0,
      clnumb,
      dummy,
      numboards=0,
      *cltop,
      *point,*ppoint,*px,*pmaxbo;

   long clsize=9999999L,
        maxhighsize=size+maxtol,
        highsize=size+tolerance,
        length[22],
        totalsize=0,
        *plength;


   pmaxbo=pointer-maxbo;

   point=boardsize;

   /*** add another board to sorted list ***/
   do {
      do {
         ++point;
         if (++numboards>numslots) goto cantfind;
         } while (!*point); /*** skip zero sized boards ***/
      ++pmaxbo;
      sortsize[++numb]=*point;
      sortpointer[numb]=numboards;
      totalsize+=*point;
      } while(totalsize<size);

   if (numb<5) goto bottomup; /*** decide which routine to use ***/
   goto try;

addaboard:
   do {
      ++point;
      if (++numboards>numslots) goto cantfind;
      } while (!*point); /*** skip zero sized boards ***/
   ++pmaxbo;
   sortsize[++numb]=*point;
   sortpointer[numb]=numboards;
   totalsize+=*point;

   if (++numover>7) goto cantfind;

try:
   /*** try this combination ***/
   *(plength=length)=totalsize;
   *(ppoint=pointer)=0;

checksize:
   /*** check these boards ***/
   if (*plength<size) goto uppoint;
   if (*plength<=highsize && ppoint>=pmaxbo)
      {
      /*** good size ***/
      px=pointer+1;
      *numused=0;
      for (dummy=1;dummy<=numb;++dummy)
         {
         if (px<=ppoint && *px==dummy)
            ++px;
         else
            used[++*numused]=sortpointer[dummy];
         }
      return(1);
      }

   /*** keep track of smallest ***/
   if (*plength<clsize && *plength<=maxhighsize && ppoint>=pmaxbo)
      {
```

```
      clnumb=numb;
      clsize=*plength;
      for (px=pointer+1,cltop=clpointer+1;px<=ppoint;++px,++cltop)
         *cltop=*px;
      }

uplevel:
   if (*ppoint<numb-1)
      {
      *(ppoint+1)=*ppoint+1;
      ++ppoint;
      *(plength+1)=*plength-sortsize[*ppoint];
      ++plength;
      goto checksize;
      }

downlevel:
   --plength;
   if (--ppoint==pointer) /*** ran out of combinations ***/
      goto addaboard;

uppoint:
   if (++*ppoint==numb) goto downlevel;
   *plength=*(plength-1)-sortsize[*ppoint];
   goto checksize;


cantfind:
   /*** couldn't find within tolerance ***/
   if (clsize==9999999L) return (3); /*** couldn't find within maxtol and maxbo ***/
   else
      /*** return closest size ***/
      {
      px=clpointer+1;
      *numused=0;
      for (dummy=1;dummy<=clnumb;++dummy)
         {
         if (px<cltop && *px==dummy)
            ++px;
         else
            usedL++*numused]=sortpointer[dummy];
         }
      return(2);
      }

bottomup:
   /*** this part of the function will search from the bottom up ***/

   pmaxbo=pointer+maxbo;

   while(++numboards<=numslots)
      {
      ++point;
      if (*point)
         {
         sortsize[++numb]=*point;
         sortpointer[numb]=numboards;
         }
      }

   *(plength=length)=0L;
   *(ppoint=pointer)=0;

clhecksize:
   /*** check these boards ***/
   if (*plength>highsize)
      {
      /*** keep track of smallest ***/
      if (*plength<clsize && *plength<=maxhighsize && ppoint<=pmaxbo)
         {
         clsize=*plength;
         for (px=pointer+1,cltop=clpointer+1;px<=ppoint;++px,++cltop)
            *cltop=*px;
```

```
        }
      goto ulppoint;
      }
   if (*plength>=size && ppoint<=pmaxbo)
      {
      /*** good size ***/
      *numused=0;
      for (px=pointer+1;px<=ppoint;++px)
         {
         usedL++*numused]=sortpointer[*px];
         }
      return(1);
      }

ulplevel:
   if (*ppoint<numb)
      {
      *(ppoint+1)=*ppoint+1;
      ++ppoint;
      *(plength+1)=*plength+sortsize[*ppoint];
      ++plength;
      goto clhecksize;
      }

dlownlevel:
   --plength;
   if (--ppoint==pointer) /*** ran out of combinations ***/
      goto clantfind;

ulppoint:
   if (++*ppoint>numb) goto dlownlevel;
   *plength=*(plength-1)+sortsize[*ppoint];
   goto clhecksize;


clantfind:
   /*** couldn't find within tolerance ***/
   if (clsize==9999999L) return (3); /*** couldn't find within maxtol and maxbo ***/
   else
      /*** return closest size ***/
      {
      *numused=0;
      for (px=clpointer+1;px<cltop;++px)
         {
         usedL++*numused]=sortpointer[*px];
         }
      return(2);
      }
   }

????????????
```

```
        zerocount,          /*** keeps track of # of boards that are in the      ***
                            /*** measurement area, but whose sizes are unknown.  ***
        rescan;             /*** if this flag is set, the machine should rescan. ***

  int code,numused,dummy,batch,boardcount,d2;
  long bestsize,totalsize;

  batch=1;
  if (sizeleft<=0)
     {
     sizeleft=size;
     boardssent=0;
     batch=0;
     }
  while (sizeleft>0)
     {
again:
     if (rescan)
        {
        zerocount=scanboards(metric);
        releasecount=0;
        }
     if (ischar() || zerocount==-1) goto abort;
     code=sizepanel(&numused,sizeleft,tolerance,maxtol,maxboardsperpanel-boardssent);
     if (ischar()) goto abort;
     if (code!=1) /*** there is no combination within initial tolerance ***/
        {
        /*** First, check how many boards are available to use ***/
        if (zerocount>2) /*** more than 2 empty slots ***/
           {
           if (releasecount==0) /*** we just scanned ... must be out of wood ***/
              {
              /* Run conveyor forward for 3.5 seconds */
              cls();
              printl(1,'Need more boards');
              outon(CONVEYOR);
              delay(3500);
              outoff(CONVEYOR);
              }
           /*** scan the boards ***/
           rescan=1;
              goto again;
              }
           /* Calculate best size */
           bestsize=0;
           for (dummy=1;dummy<=numslots;++dummy)
              {
              bestsize+=boardsize[dummy];
              }
           bestsize/=2;
           if (sizeleft>bestsize) /*** reasonable for double batch ***/
              {
              /* send sizeleft-bestsize or all, whichever's smaller */
              totalsize=0;
              numused=0;
              do {
                 ++numused;
                 used[numused]=numused;
                 totalsize+=boardsize[numused];
                 }
                 while (totalsize<sizeleft-bestsize-1.5 && numused<numslots);
              if ((float)numused>((float)totalsize/size)*maxboardsperpanel)
                 { /*** the number of boards we were going to send out in this batch ***/
                   /*** would be more than 10% over the percentage of max boards     ***/
                   /*** based on size ***/
                 cls();
                 printl(1,'Can't find\nwithin max\nboards/panel.\nRemove Smallest.');
                 outon(CONVEYOR);
                 delay(3500);
                 outoff(CONVEYOR);
                 goto again;
                 }
              }
```

```
   else if (code==3) /*** not reasonable to double batch, choke if not within max*
      {
      cls();
      printl(1,'Cant find within\nmax. tolerance.\nRemove a board.');
      outon(CONVEYOR);
      delay(3500);
      outoff(CONVEYOR);
      goto again;
      }
   }
/*** send boards: let dummy point thru all selected boards ***/
/***              let boardcount count # of boards sent    ***/
dummy=1;
while (dummy<=numused)
   {
   /*** Wait if stop wand hit ***/
   do {
      if (ischar()) goto abort;
      }
      while (!sense(STOPWAND));

   /* Send selected boards */
   ++releasecount;
   boardcount=1;
   while (dummy<=numused && boardcount<=maxboards)
      {
      if (boardsize[used[dummy]]!=0)
         {
      outon(cyl(used[dummy]));
      sizeleft-=boardsize[used[dummy]];
      boardsize[used[dummy]]=0;
      ++boardcount;
      ++boardssent;
      ++zerocount;
      }
   ++dummy;
   }
outon(CONVEYOR);
if (batch++) delay(300);
outon(APPLICATOR);
delay(500);
for (d2=1;d2<=numslots;++d2)
   outoff(cyl(d2));
delay(400);  /* wait another .5 sec to make sure panel done */
while (!sense(EYE));
while (sense(EYE))
   {  /* let stopwand control conveyors */
   if (!sense(STOPWAND))
      {
      d2=0;
      while (sense(EYE) && !sense(STOPWAND))
         {
         if (++d2>3000)
            {
            /*** turn off conveyors and wait for stopwand or eye
            *** to be cleared */
            outoff(CONVEYOR);
            outoff(APPLICATOR);
            while(!sense(STOPWAND) && sense(EYE));
            /*** restart the coveyors if the stopwand is cleared ***/
            if (sense(STOPWAND))
               {
               outon(APPLICATOR);
               delay(300);
               outon(CONVEYOR);
               }
            }
         }
      }
   }
outoff(CONVEYOR);
if (code!=3 && dummy==numused)
   { /*** This is the last batch of this panel ***/
```

```
            delay(400);
            }
         outoff(APPLICATOR);
         }
      }
   return(numused);
abort:
   if (sizeleft==size) sizeleft=0;
   return(0);
   }

%%%
```

```
        }
      } while (time<5000 );
    if (d3<1000)
       {
       telluser('Slow down\ntraverse.  Then\nhit any key.');
       goto fourscans;
       }
    if (d3>2000)
       {
       telluser('Speed up\ntraverse.  Then\nhit any key.');
       goto fourscans;
       }
    }
  /*** four scans completed, check values obtained ***/
     d2=count[1];
     if (d2!=count[2] || d2!=count[3] || d2!=count[4])
       {
       telluser('Intermitant\ndelimeter sensor\nproblem:  Slow\ndown traverse.');
       goto fourscans;
       }
     if (d2<13 || d2>23) /*** bad count ***/
       {
       telluser('Bad delimeter\ncount.  Check\ndelimeter posi-\ntions, hit key');
       goto fourscans;
       }
     d2=0;
     d3=0;
     for (dummy=1;dummy<=4;++dummy)
       {
       d2+=high[dummy]/4;
       d3+=low[dummy]/4;
       }
     for (dummy=1;dummy<=4;++dummy)
       {
       if (high[dummy]-d2>400 || d2-high[dummy]>400 || low[dummy]-d3>400 || d3-low[dur
          {
          telluser('Inconsistant\nultrasonic\nsensor readings:\nReplace?');
          }
       }
checkagain:
      if (d2<800 || d2>1100 || d3<3500 || d3>3800)
       {
       cls();
       if (d2<800 || d2==32000)
          {
          printl(1,'Turn zero screw\nout 1/4 turn.\nThen hit any\nkey.');
          waitstart();
          cls();
          }
       if (d2>1100)
          {
          printl(1,'Turn zero screw\nin 1/4 turn.\nThen hit any\nkey.');
          waitstart();
          cls();
          }
       if (d3<3500)
          {
          printl(1,'Turn span screw\nin 1/4 turn.\nThen hit any\nkey.');
          waitstart();
          cls();
          }
       if (d3>3800)
          {
          printl(1,'Turn span screw\nout 1/4 turn.\nThen hit any\nkey.');
          waitstart();
          cls();
          }
       scanstart();
       for (dummy=1;dummy<=numslots+2;++dummy)
          readsize(0);
       d3=readsize(0);
       d2=readsize(1);
       goto checkagain;
       }
```

```
   /*** test inputs ***/
   cls();
   printl(1,'Input Tests\n\n\nTrip the Eye\n');
   dummy=sense(EYE);
   while(dummy==sense(EYE));
   printl(1,'Move Stop Wand');
   dummy=sense(STOPWAND);
   while (dummy==sense(STOPWAND));

   /* Test gage block settings */
   cls();
   ccode=longinput((long)ccode,3,0,' -   Enter\nCalibration Code');
   cls();
   printl(1,'Put 1\' blocks\nin first & last\nslots.  Then hit\nany key.');
   leftgood=0;
   rightgood=0;
   waitstart();
gageagain:
   cls();
   for (d3=1,dummy=0,d2=0;d3<=3;++d3)
      {
      outon(CONVEYOR);
      for (d4=1;d4<=15000;++d4);
      outoff(CONVEYOR);
      scanboards(0);
      if (boardsize[1]==32000 || boardsize[numslots]==32000)
         {
         cls();
         printl(1,'Error ...\nTry slowing\nTraverse');
         goto gageagain;
         }
      dummy+=boardsize[1];
      d2+=boardsize[numslots];
      }
   dummy/=3;
   d2/=3;
   if (dummy>=1495-ccode && dummy<=1500-ccode) rightgood=1; /* Right gage block successf
   if (d2>=1495-ccode && d2<=1500-ccode) leftgood=1; /* Left gage block successful */
   if (!rightgood || !leftgood)
      {
      if (!rightgood)
         {
         cls();
         printl(1,'Move gage block\n#1 ');
         if (dummy<1495-ccode)
            {
            printl(1,'down ');
            f=(1497-ccode-dummy)*.02;
            }
         else
            {
            printl(1,'up ');
            f=(dummy-(1497-ccode))*.02;
            }
         if (f<.125) f=.125;
         printfract(1,f,8);
         printl(1,'\nturn.  Then hit\nany key.');
         waitstart();
         }
      if (!leftgood)
         {
         cls();
         printl(1,'Move gage block\n#2 ');
         if (d2<1495-ccode)
            {
            printl(1,'down ');
            f=(1497-ccode-d2)*.02;
            }
         else
            {
            printl(1,'up ');
            f=(d2-(1497-ccode))*.02;
            }
```

```
        if (f<.125) f=.125;
        printfract(1,f,8);
        printl(1,'\nturn.  Then hit\nany key.');
        waitstart();
        }
      goto gageagain;
      }
   telluser('Diagnostics\nCompleted, hit\nany key to\ncontinue.');
   outon(CONVEYOR);
   delay(3000);
   outoff(CONVEYOR);
   }
????????????????
```

The flow chart of FIG. 10 is presented to aid in understanding the operations described in the computer program listed above. In FIG. 10, numeral 100 denotes start of the flowchart. Numeral 102 denotes the settings formed by the user utilizing keyboard 48, described in connection with FIG. 9 above. Standard diagnostic tests performed on the computer operations are indicated at numeral 104 in FIG. 10.

Steps 106 and 108 in the flow chart indicates the lack of the indication that the apparatus should stop; namely, that no key on the controller 48 has been depressed or no indication that the stop wand 8 is in the position shown in FIG. 1.

The next function 110 is to scan the boards and again, in 112, sense that any key is depressed. The boards are selected through the combination of functions 114, 116, 118, 120 and 122. Again, the sensing of whether any key is pressed, is indicated in block 124. The boards are then sent to glue applicator, as indicated at 126 in FIG. 10.

The equations for measuring a particular board will be described below.

In the equations following, the following applies:

$V_1$=value of 6" reference left (or right); $V_2$=value of 1" reference left; $V_3$=value of 1" reference right; $V_n$=value of a selected workpiece; $d_n$=the distance to the workpiece selected (i.e. $V_n$); and $d_3$=distance between $V_2$ and $V_3$.

Calibration from far left to far right (or vice versa) is represented by the following equation:

$$g_1 = \frac{d_n}{d_3}(V_3 - V_2) + V_2 \qquad g_6 = \frac{d_n}{d_3}(V_3 - V_2) + V_1$$

The above equation is designed to calibrate the height above the boards of the analog sensor and the digital sensor. The calibration equation above recognizes that the height may be uneven from one far end support to the other. More specifically, and with reference to FIG. 5 for example, the height of the scanning support 98,96 as mounted on rodless cylinder 24 and supported by vertical supports 86,88 may not be uniform from one end to the other. Thus, the 6" references and the 1" references are used in the program to develop the calibration signals $g_1$ and $g_6$ representative of any difference in height of the mounting of the analog scanner. More specifically, if the analog electrical signal $V_3$ is greater than $V_2$ then a calibration signal $g_1$ is generated in lines "$g_1$" and "$g_6$" of the computer program described infra. The signal is generated for the board located at a location $D_n$ corresponding to the voltage $V_n$. In this manner, the computer program generates a correction signal for each board location representative of the height differential between the two references, $V_3$ and $V_2$.

The height calibration is developed in the equation which follows. In this equation, the difference between the 1" reference and the 6" reference is utilized to establish in the program calibration of each of the locations $g_1$.

The height calibration is represented by the following equation:

$$\text{Height} = 1 + 5\,\frac{(g_1 - V_n)}{g_1 - g_6}$$

My invention recognizes that there are several alternatives to approaching computer analysis of a multiplicity of different sized boards so as to determine which of the boards make up the desired width panel.

One way to size the panels is to go through the signals representative of the size of each board and adding up the sizes, comparing them to the desired size and going immediately to the next combination if the combination size exceeds the maximum allowable panel size. This approach involves the necessity to perform calculations on every combination of panels.

Another method which may be employed is to take the first n (say 5) boards such that the total size is over the desired panel width. Then, from this combination of the first n boards over the panel width, combinations of boards are subtracted from the total size to get a result of the proper size. The advantage in this method is that you are taking combinations of boards at a time so that a more rapid process is involved in reaching the combination of the desired size.

One of the problems in working with this approach is that combinations of boards are repeated. For example, if in this approach eight boards are being examined subtracting one, two, three at a time and no combination is found, the approach must look at nine boards so that any combination that subtracts the ninth board involves simply a repeat of one of the combinations tried when looking at eight boards.

The approach employed in the present program involves several repeats. Lines "make a panel" through "can't find within tolerance" of the program described infra control the selection process such that, for example if nine boards are being tried, the program avoids any combination that subtracts the ninth board (as this was already accomplished in analysis of eight boards). Further, if a combination of ten boards is being analyzed, the program does not calculate any combination based on subtraction of board number ten.

In establishing the methods above, the determinations were based on a test of sizing panels 12" to 30" wide on a machine with thirteen slots and board sizes ranging from 1" to 3".

Obviously, depending upon other numbers of boards, panel sizes, and combinations, other differing methods may be employed.

While a specific embodiment of this invention is described as is shown herein, it is to be understood that other embodiments may be resorted to without departing from the spirit and scope of the invention.

I claim:

1. An apparatus for selecting among workpieces for further processing comprising:

infeed means for supporting and advancing work pieces from a first station to a second station;

means at said second station for inspecting said work pieces and developing electrical signals indicative of the height of each of said work pieces;

means connected to receive said electrical signals for comparing said electrical signals with predetermined height requirements and for generating output signals as a result of said comparison;

selection means mounted in proximity to said work pieces and coupled to receive said output signals for simultaneously selecting at least two of said work pieces;

conveying means mounted in proximity to said selection means for simultaneously conveying said selected work pieces for further processing; and recording and control means connected to said conveying means for recording parameters relating to the operation of the apparatus and for generating a control signal when a predetermined number of selected work pieces have been conveyed for further processing.

2. Apparatus for automatically selecting a number of work pieces for further processing to combine said selected workpieces into an intermediate product of predetermined dimensions comprising:

supply means for supplying a plurality of workpieces of different dimension;

signal generating means for generating an electrical signal representative of the height dimension of each of said workpieces, said signal generating means including:

support means for said signal generating means connected to said supply means;

movable mounting means connected to said support means and to said signal generating means for conveying said signal generating means in proximity to said workpieces;

scanning means mounted on said movable mounting means for generating a first electrical signal indicative of said height dimension of each of said workpieces and a second electrical signal identifying each of said workpieces;

means connected to said signal generating means for simultaneously selecting at least two of said workpieces for further processing; and recording and control means connected to said conveying means for recording parameters relating to the operation of the apparatus and for generating a control signal when a predetermined number of selected work pieces have been conveyed for further processing.

3. The apparatus of claim 2 wherein said supply means includes a plurality of separate tracks, each of said tracks being formed by a plurality of rails separating one track from the other; and rotating means mounted beneath said rails for advancing said work pieces within said rails.

4. The apparatus of claim 2 wherein said means for selecting at least one of said work pieces includes gating means operable in a first position to block passage of said work pieces and in a second position to permit passage of said work pieces; said gate means including a plurality of individually operable means each coupled to said signal generating means.

5. The apparatus of claim 4 further including means coupled to said means for receiving said work pieces on said gate means assuming said second position, said receiving means including means coupled to receive said work pieces to concentrate said work pieces; gluing means coupled to receive said work pieces after concentration thereof for applying glue to one surface of said work pieces; and means contacting said glued work pieces for stopping said apparatus on arrival of said glued work pieces at a predetermined location.

6. The apparatus of claim 5 wherein said stopping means includes a sensor mounted for contacting said glued work pieces and for stopping said apparatus when said sensor is in a first position and for permitting said apparatus to operate when said sensor is in a second position, said sensor being driven to said first position by the presence of work pieces contacting said sensor wand.

7. The apparatus of claim 2 wherein said first electrical signal is an analog signal and said second electrical signal is a digital signal.

8. The apparatus of claim 1 further including means at said second station for inspecting said workpieces and developing an electrical signal indicative of the location of each of said workpieces.

9. The apparatus of claim 8 wherein said electrical signals indicative of the height of each of said workpieces are analog signals and the electrical signals indicative of the location of each of said workpieces are digital signals.

10. The apparatus of claim 1 wherein said inspecting means includes transporting means coupled to said electrical signal developing means for carrying said electrical signal developing means across said workpieces.

11. The apparatus of claim 1 further including calibrating means at said second station for generating a calibration reference signal indicative of height.

* * * * *